US008763206B1

(12) United States Patent
Gong

(10) Patent No.: US 8,763,206 B1
(45) Date of Patent: Jul. 1, 2014

(54) HINGE

(71) Applicants: Fu Tai Hua Industry (Shenzhen) Co., Ltd., Shenzhen (CN); Hon Hai Precision Industry Co., Ltd., New Taipei (TW)

(72) Inventor: Hai-Tao Gong, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/959,743

(22) Filed: Aug. 6, 2013

(30) Foreign Application Priority Data

Dec. 24, 2012 (CN) ..... 2012 1 0565206

(51) Int. Cl.
*E05D 1/04* (2006.01)
*E05D 11/06* (2006.01)

(52) U.S. Cl.
USPC ..... 16/355; 16/357; 16/362

(58) Field of Classification Search
USPC ..... 16/364–366, 362, 355, 356, 357, 358, 16/359, 360, 361, 387, 389, 254, 261, 262, 16/363
See application file for complete search history.

(56) References Cited

U.S. PATENT DOCUMENTS

| | | | | | |
|---|---|---|---|---|---|
| 93,402 | A | * | 8/1869 | Blake | 16/355 |
| 819,098 | A | * | 5/1906 | Underhill | 16/355 |
| 1,486,371 | A | * | 3/1924 | Forbes | 16/272 |
| 1,648,781 | A | * | 11/1927 | Pepin | 16/355 |
| 2,056,805 | A | * | 10/1936 | Reichard | 16/355 |
| 2,203,041 | A | * | 6/1940 | Bobek | 16/245 |
| 2,770,834 | A | * | 11/1956 | Jannace | 16/250 |
| 4,683,614 | A | * | 8/1987 | Anderson | 16/362 |
| 5,061,023 | A | * | 10/1991 | Soubliere et al. | 312/223.4 |
| 5,946,774 | A | * | 9/1999 | Ramsey et al. | 16/357 |
| 6,317,929 | B1 | * | 11/2001 | Ring | 16/355 |

* cited by examiner

*Primary Examiner* — Chuck Mah
(74) *Attorney, Agent, or Firm* — Novak Druce Connolly Bove + Quigg LLP

(57) ABSTRACT

The hinge includes an tubular element, a pair of curved beams which are arc-shaped, and a pair of positioning pins. Two curved through holes are formed in the tubular element and are aligned in parallel to each other, the pair of positioning pins are fixed on two opposite sidewalls of the tubular element, each of the pair of curved beams defines a protrusion on an external surface thereof. The pair of curved beams respectively slide in the two curved through holes and the two protrusions are configured to limit a position where the pair of curved beams are in the two curved through holes.

6 Claims, 8 Drawing Sheets

HINGE

BACKGROUND

1. Technical Field

The disclosure relates to connecting configuration and, more particularly, to a hinge connected to an object.

2. Description of Related Art

A hinge is utilized for a panel and often includes a shaft. When a user closes the panel via the hinge, the shaft often is rotated and exposed, and the user can look at the shaft, therefore, it is easy to affect a whole appearance of the panel.

Therefore, what is needed is a hinge to overcome the described shortcomings.

DETAILED DESCRIPTION

Figure 1:
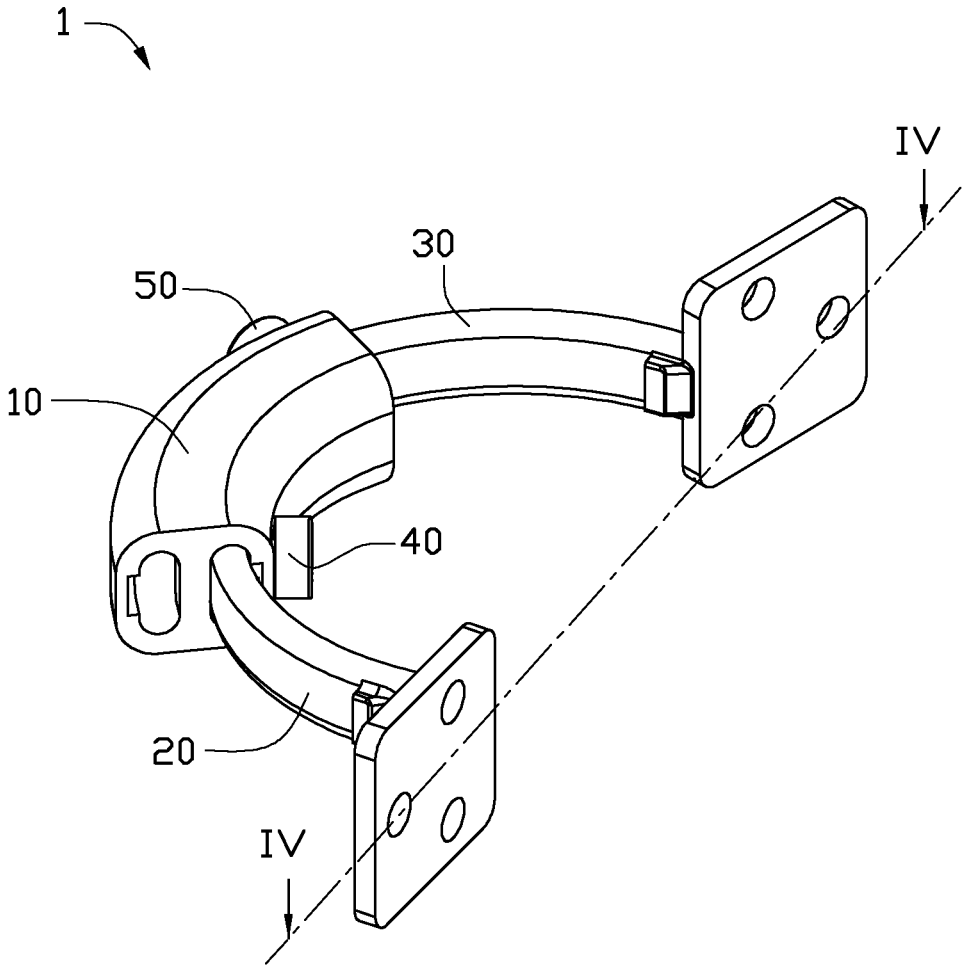
FIG. 1 is a perspective view of a hinge in an open state in accordance with an exemplary embodiment.
Figure 2:
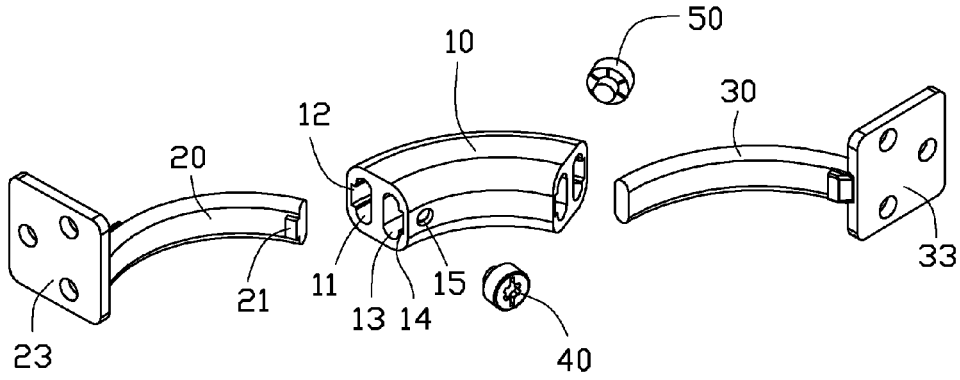
FIG. 2 is an exploded, perspective view of the hinge of FIG. 1.
Figure 3:
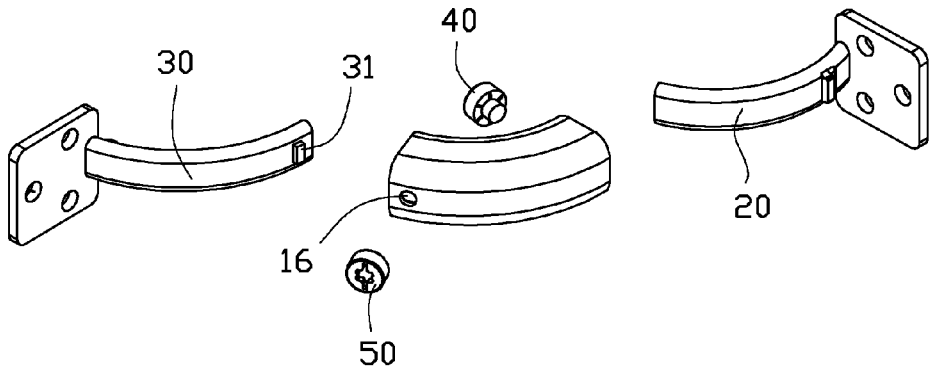
FIG. 3 is similar to FIG. 2 but viewed from another angle.

Referring to FIGS. 1-3, a hinge 1 includes a tubular element 10, a pair of curved beams 20, 30, and a pair of positioning pins 40, 50. The tubular element 10 has a first end and an opposing second end. Two through holes 11, 13 are formed in the tubular element 10 and are aligned in parallel to each other. Each of the two through holes 11, 13 extends from the first end to the second end of the tubular element 10 along a curved course.

The tubular element 10 defines a first groove 12 in a sidewall of the first through hole 11 and a second groove 14 in an opposite sidewall of the second through hole 13. A first protrusion 31 is formed on the first curved beam 30 and slidably engaged in the first groove 12, and a second protrusion 21 is formed on the second curved beam 20 and slidably engaged in the second groove 14.

The two curved beams 20, 30 are arc-shaped. In the embodiment, the two curved beams 20, 30 have the same configuration. In another embodiment, the two curved beams 20, 30 have different configuration, for example, a thickness of the curved beam 20 is greater than a thickness of the curved beam 30. The first curved beam 30 is slidaby received in the first through hole 11. The first curved beam 30 has a first distal end exposed outside the tubular element 10 adjacent to the first end of the tubular element 10 and an opposing second distal end. A first mounting plate 33 is connected to the first distal end of the first curved beam 30. The second curved beam 20 is slidably received in the second through hole 13. The second curved beam 20 has a first distal end exposed outside the tubular element 10 adjacent to the second end of the tubular element 10 and an opposing second distal end which are arc-shaped. A second mounting plate 23 is connected to the first distal end of the second curved beam 20.

The second distal end of the first curved beam 30 is positioned in the first through hole 11 and the first distal end 33 of the first curved beam 30 is connected to a first sidewall of an object. The first curved beam 30 can slide in the first through hole 11. The first curved beam 30 defines a first protrusion 31 on an external surface thereof and the first protrusion 31 can slide in the first groove 12. When the first curved beam 30 slides along an opposite direction, such as right, the first protrusion 31 slides to a position where the first positioning pin 50 withstands the first protrusion 31, thus the first curved beam 30 cannot move.

The second distal end of the second curved beam 20 is positioned in the second through hole 13 and the first distal end 23 of the curved beam 20 is connected to a second sidewall of the object. The second curved beam 20 can slide in the second through hole 13. The second curved beam 20 defines a second protrusion 21 on an external surface thereof and the second protrusion 21 can slide in the second groove 14. The second protrusion 21 slides to a position where the second positioning pin 40 withstands the second protrusion 21 when sliding along a direction, such as left, thus, the second curved beam 20 cannot move. The first protrusion 31 is arranged at the second distal end of the first curved beam 30 and the second protrusion 21 is arranged at the second distal end of the second curved beam 20.

The positioning pin 50 is fixed on the sidewall of the tubular element 10 and the positioning pin 40 is fixed on the opposite sidewall of the tubular element 10. In another embodiment, the two curved through holes 11, 13 do not define grooves.

In the embodiment, the two positioning pins 40, 50 are screws, a screw thread through hole 16 is formed on the sidewall of the tubular element 10, and a screw thread through hole 15 is formed on the opposite sidewall of the tubular element 10.

The first and second curved beams are slidable relative to the tubular element 10 between a first position where the second distal end of the first curved arm 30 is moved adjacent to the first end of the tubular element 10 and the second distal end of the second curved arm 20 is moved adjacent to the second end of the tubular element 10, and a second position where the second distal end of the first curved arm 30 is moved adjacent to the second end of the tubular element 10 and the second distal end of the second curved arm 20 is moved adjacent to the first end of the tubular element 10.

In another embodiment, both the curved beam 20 and the protrusion 21 slide in the curved through hole 13, and both the curved beam 30 and the protrusion 31 slide in the curved through hole 11.

The sum of a diameter of the curved through hole 11 and a thickness of the groove 12 is equal to or greater than the sum of the thickness of the curved beam 30 and a thickness of the protrusion 31. The sum of a diameter of the curved through hole 13 and a thickness of the groove 14 is equal to or greater than the sum of the thickness of the curved beam 20 and a thickness of the protrusion 21. In the embodiment, the diameter of the curved through hole 11 is equal to the thickness of the curved beam 30, and the thickness of the groove 12 is equal to the thickness of the protrusion 31. The diameter of the curved through hole 13 is equal to the thickness of the curved beam 20, and the thickness of the groove 14 is equal to the thickness of the protrusion 21.

Figure 4:
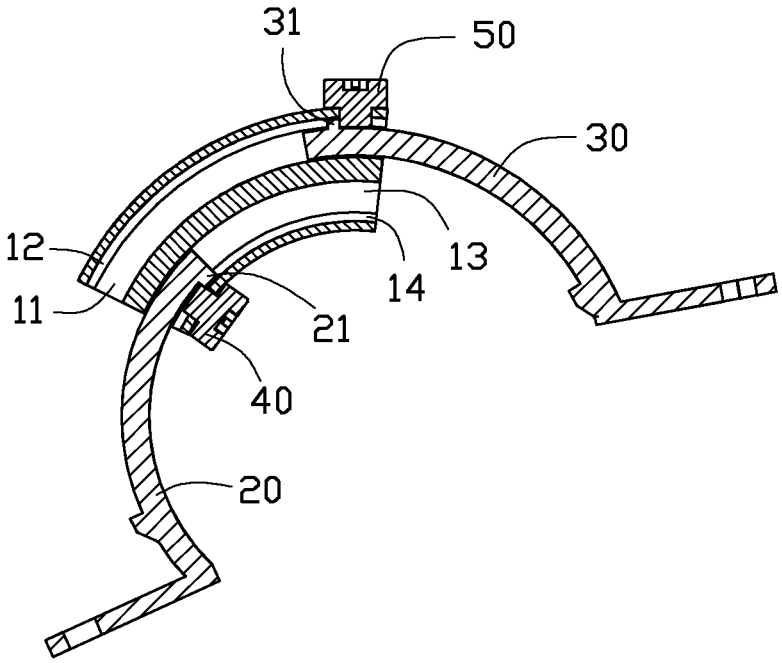
FIG. 4 is a sectional view of the hinge of FIG. 1.

As shown in FIG. 4, the hinge 1 is in an open state. In the embodiment, the two positioning pins 40, 50 are fixed at the two opposite ends of the tubular element 10. The two curved beams 20, 30 slide along two opposite directions, when the two positioning pins 40, 50 withstand the two protrusions 21, 31 in the first position, respectively, the two curved beams 20, 30 are away from the tubular element 10, and the hinge 1 becomes longer at the maximum position. In the first position, the first mounting plate 33 is substantially parallel with the second mounting plate 23.

Figure 5:
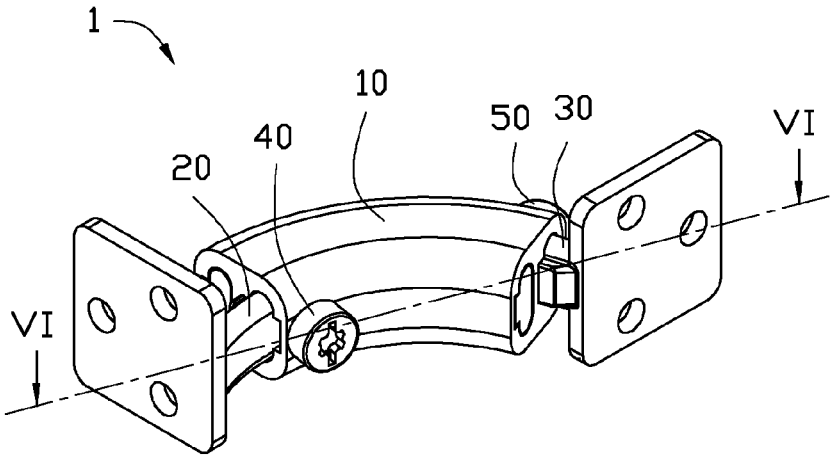
FIG. 5 is a perspective view of the hinge of FIG. 1 in a closed state.
Figure 6:
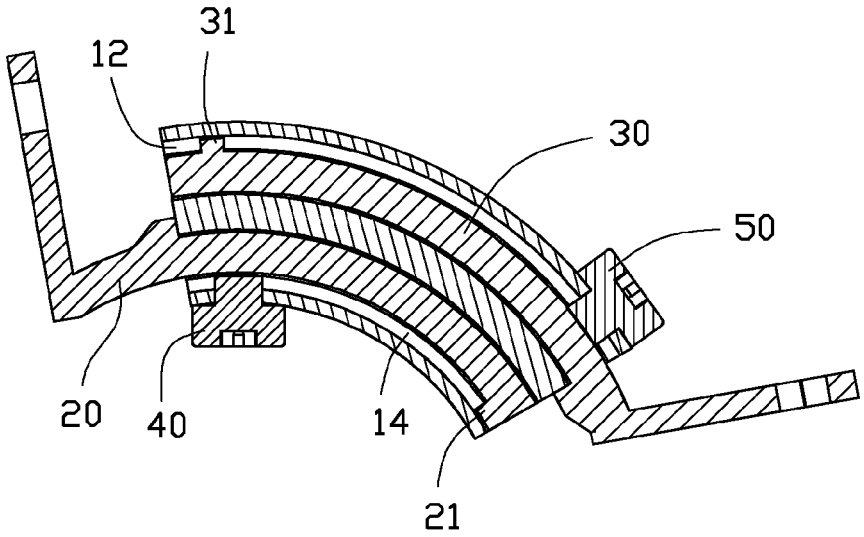
FIG. 6 is a sectional view of the hinge of FIG. 5.

Referring to FIGS. 5 and 6, the hinge 1 is in a closed state. The two curved beams 20, 30 slide along two opposite directions and are accommodated in the tubular element 10, and the hinge 1 becomes shorter at the minimum position. In the second position, the first mounting plate 33 is substantially perpendicular to the second mounting plate 23.

Figure 7:
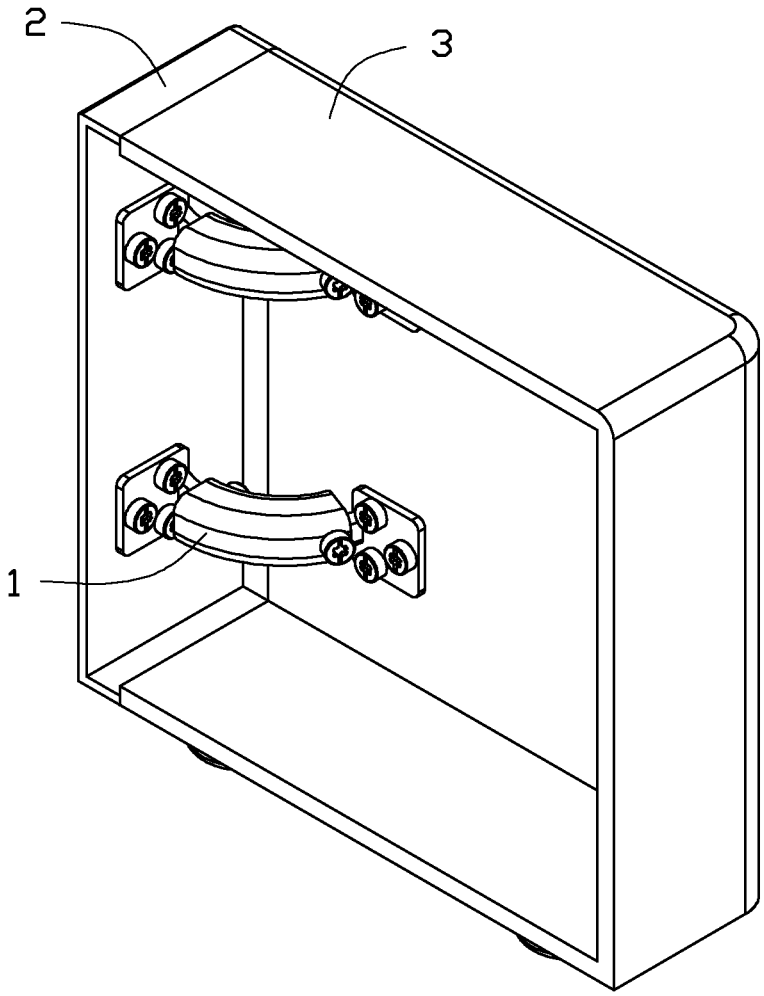
FIG. 7 is a perspective view of the hinge of FIG. 5, together with an object.

As shown in FIG. 7, the hinge 1 is configured to be connected to two sidewalls 2, 3 of the object in the second position, such as a box. Both the object and the hinge 1 are in the closed state, and a user cannot look at the hinge 1 out of the object.

Figure 8:
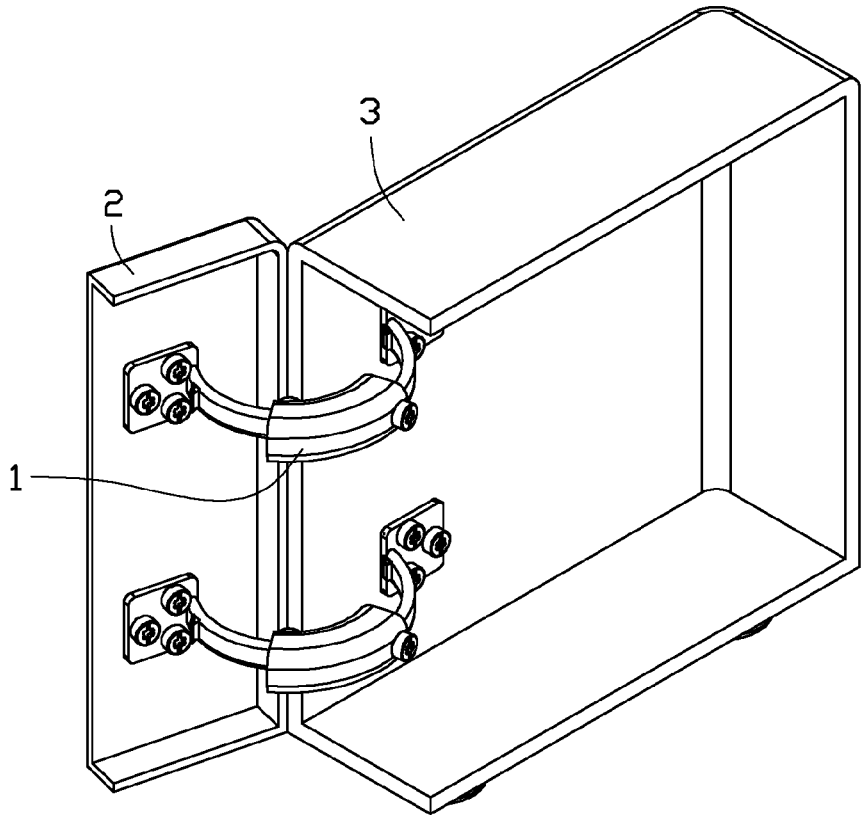
FIG. 8 is a perspective view of the hinge of FIG. 1, together with an object.

As shown in FIG. 8, when an external force is utilized to pull the sidewall 2 of the object in FIG. 7, the two curved beams 20, 30 are pulled out from the tubular element 10, and the hinge 1 becomes longer in the first position. Therefore, the hinge 1 establishes a switch between the open state and the closed state.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A hinge comprising:

a tubular element having a first end and an opposing second end, the tubular element defining a first through hole and a second through hole parallel with the first through hole, each of the first and second through holes extending from the first end to the second end along a curved course;

a first curved beam slidaby received in the first through hole, the first curved beam having a first distal end exposed outside the tubular element adjacent to the first end of the tubular element and an opposing second distal end;

a first mounting plate connected to the first distal end of the first curved beam;

a second curved beam slidably received in the second through hole, the second curved beam having a first distal end exposed outside the tubular element adjacent to the second end of the tubular element and an opposing second distal end; and a second mounting plate connected to the first distal end of the second curved beam;

wherein the first and second curved beams are slidable relative to the tubular element between a first position where the second distal end of the first curved beam is moved adjacent to the first end of the tubular element and the second distal end of the second curved beam is moved adjacent to the second end of the tubular element, and a second position where the second distal end of the first curved beam is moved adjacent to the second end of the tubular element and the second distal end of the second curved beam is moved adjacent to the first end of the tubular element.

2. The hinge as recited in claim 1, wherein in the first position, the first mounting plate is substantially parallel with the second mounting plate.

3. The hinge as recited in claim 1, wherein in the second position, the first mounting plate is substantially perpendicular to the second mounting plate.

4. The hinge as recited in claim 1, wherein the tubular element defines a first groove in a sidewall of the first through hole and a second groove in a sidewall of the second through hole, a first protrusion is formed on the first curved beam and slidably engaged in the first groove, and a second protrusion is formed on the second curved beam and slidably engaged in the second groove.

5. The hinge as recited in claim 4, wherein the first protrusion is arranged at the second distal end of the first curved beam and the second protrusion is arranged at the second distal end of the second curved beam.

6. The hinge as recited in claim 5, wherein the tubular element, at the first end thereof, defines a first positioning hole in communication with the first through hole, and at the second end thereof defines a second positioning hole in communication with the second through hole, a first positioning pin is inserted in the first positioning hole for blocking movement of the first protrusion toward the first end of the tubular element, and a second positioning pin is inserted in the second positioning hole for blocking movement of the second protrusion toward the second end of the tubular element.

* * * * *